US006745162B1

(12) United States Patent
Hu

(10) Patent No.: US 6,745,162 B1
(45) Date of Patent: Jun. 1, 2004

(54) SYSTEM AND METHOD FOR BIT ALLOCATION IN AN AUDIO ENCODER

(75) Inventor: Fengduo Hu, Cupertino, CA (US)

(73) Assignees: Sony Corporation, Tokyo (JP); Sony Electronics, Inc., Parkridge, NJ (US)

( * ) Notice: Subject to any disclaimer, the term of this patent is extended or adjusted under 35 U.S.C. 154(b) by 314 days.

(21) Appl. No.: 09/694,474

(22) Filed: Oct. 23, 2000

Related U.S. Application Data

(60) Provisional application No. 60/213,154, filed on Jun. 22, 2000.

(51) Int. Cl.[7] ..... G10L 19/00

(52) U.S. Cl. ..... 704/200.1; 704/500; 704/229; 704/205; 704/203; 375/241; 375/242

(58) Field of Search ..... 704/500, 229, 704/205, 203, 200.1; 375/241, 242

(56) References Cited

U.S. PATENT DOCUMENTS 5,537,510 A * 7/1996 Kim ..... 704/229
5,588,024 A * 12/1996 Takano ..... 375/242
5,592,584 A * 1/1997 Ferreira et al. ..... 704/203
5,625,743 A * 4/1997 Fiocca ..... 704/205
5,627,937 A * 5/1997 Kim ..... 704/229
5,761,636 A * 6/1998 Bolton et al. ..... 704/229
5,764,698 A * 6/1998 Sudharsanan et al. ..... 375/241
5,956,674 A * 9/1999 Smyth et al. ..... 704/200.1
5,987,407 A * 11/1999 Wu et al. ..... 704/200.1
6,104,996 A * 8/2000 Yin ..... 704/500
6,134,523 A * 10/2000 Nakajima et al. ..... 704/229
6,240,379 B1 * 5/2001 Yin ..... 704/200.1
6,487,535 B1 * 11/2002 Smyth et al. ..... 704/500

OTHER PUBLICATIONS

"Digital Audio Compression Standard (AC–3)", Doc.A/52Advanced Television System Committee, Dec. 20, 1995, pp. 50–51.*

Noll, "MPEG Digital Audio Coding Standards", CRC Press LLC, 1999.*

European Telecommunication Standard, "Radio Broadcasting Systems; Digital Audio Broadcasting (DAB) to Mobile, Portable and Fixed Receivers," Final Draft, pr ETS 300 401, Feb. 1997, Second Edition. 221 pages.

K. Konstantinides, "Fast Subband Filtering in MPEG Audio Coding," IEEE Signal Processing Letters, vol. 1, No. 2, Feb. 1994. pp. 26–28.

(List continued on next page.)

*Primary Examiner*—Richemond Dorvil
*Assistant Examiner*—Qi Han
(74) *Attorney, Agent, or Firm*—Charles J. Kulas; Carpenter & Kulas, LLP

(57) ABSTRACT

The present invention relates to a system and method which serves as a refinement in the criteria used to improve the performance of audio signal processing systems. More specifically, the present invention provides a method by which the frequency and magnitude of artifacts added to audio signal data in an encoder device can be reduced. The encoding device through which the audio signal passes includes a filter bank for filtering source audio data to produce frequency sub-bands, a psycho-acoustic modeler for calculating signal to masking ratios from the frequency sub-bands of the source audio data, and a bit allocator for assigning for using the signal to masking ratios to assign a finite number of bits to represent the frequency sub-bands. In the absence of a significant event, the bit allocator performs a pre-bit allocation procedure to prevent artifacts or discontinuities in the encoded audio data.

23 Claims, 4 Drawing Sheets

OTHER PUBLICATIONS

M. Kumar and M. Zubair, "A High Performance Software Implementation of MPEG Audio Encoder," IEEE, 1996, pp. 1049–1052.

Sung–Hee Park, et al., "Fast Algorithm on MPEG/Audio Subband Filtering," Audio Engineering Society—99$^{th}$ Convention, Oct. 1995, (4090 J–5) 11 pages.

Laurent Mainard, et al., "A Real–Time PC–Based High Quality MPEG Layer II Codec," Audio Engineering Society—101$^{st}$ Convention, Nov., 1996 (4345 F–4) 8 pages.

Karlheinz Brandenburg and Gerhard Stoll, "The ISO/MPEG–Audio Codec: A Generic Standard for Coding of High Quality Digital Audio," Audio Engineering Society—92$^{nd}$ Convention, Mar., 1992, 12 pages.

Martin Dietz, et al., "Audio Compression for Network Transmission," Audio Engineering Society—99$^{th}$ Convention, Oct. 1995, (4129 D–6) 9 pages.

* cited by examiner

SYSTEM AND METHOD FOR BIT ALLOCATION IN AN AUDIO ENCODER

CROSS-REFERENCES TO RELATED APPLICATIONS

The present application is related to, and claims priority from, the co-pending U.S. Provisional Patent Application entitled "An Improved Bit Allocation Method for Preventing Audible Artifacts in MPEG Audio Encoder", Serial No. 60/213,154, filed Jun. 22, 2000, which is hereby incorporated by reference.

BACKGROUND OF THE INVENTION

The present invention relates generally to signal processing systems, and more specifically to a refined system and method for allocating bits in an audio encoder such as an MPEG encoder.

Implementing an effective and efficient method of encoding audio data is often a significant consideration for designers, manufacturers, and users of contemporary electronic systems. The evolution of modern audio technology has necessitated corresponding improvements in sophisticated, high-performance audio encoding methodologies. For example, the advent of recordable audio compact disc devices typically requires an encoder-decoder (codec) system to receive and encode source audio data into a format (such as MPEG) that may then be recorded onto appropriate media using the compact disc device.

Many portions of the audio encoding processes are subject to strict technological standards that do not permit system designers to vary the data formats or encoding techniques. Other segments of the audio encoding process may not be altered because the encoded audio data must conform to certain specifications so that a standardized decoding device is able to successfully decode the encoded audio data. These foregoing constraints create substantial limitations for system designers who wish to improve the performance of an audio encoding device.

Transparent reproduction of audio data into the appropriate format is the ultimate goal of most audio encoding systems. The main factor which prevents an encoding system from attaining this goal are the artifacts introduced to the audio data during the encoding process. In other words, an audio decoder must be able to decode the encoded audio data for transparent reproduction by an audio playback system without introducing any sound artifacts created by the encoding and decoding process.

Digital audio encoders typically process and compress sequential units of audio data called "frames." A particularly objectionable sound artifact called a "discontinuity" may be created when successive frames of audio data are encoded with non-uniform amplitude or frequency components. Each frame contains a large amount of varying audio information. Therefore treating the varying audio information contained within a frame as one large uniform unit can force some of the subtleties of the audio data to be lost. Additionally, treating each frame as a uniform unit can introduce larger discontinuities between successive frames. The discontinuities become readily apparent to the human ear whenever the encoded audio data is decoded and reproduced by an audio playback system.

Furthermore, to effectively encode audio data, the audio encoder must allocate a finite number of binary digits (bits) to the frequency components of the audio data, so that the encoding process achieves optimal representation of the source audio data. An efficient bit allocation technique which prevents discontinuity artifacts would thus provide significant advantages to an audio decoder device.

A paper entitled "A Real-Time PC-Vased High Quality MPEG Layer II Codec" by Laurent Mainard, et al., presented at the 101st Convention of the Audio Engineering Society, Nov. 8–11, 1996, proposed restrictions on the allocated/non-allocated state switching based on the evolution of the scalefactors. However, this article did not account for all audio artifacts which may arise with input audio data.

SUMMARY OF THE INVENTION

The present invention relates to a system and method which serves as a refinement in the criteria used to improve the performance of audio signal processing systems. More specifically, the present invention provides a system and method by which the frequency and magnitude of artifacts added to audio signal data in an encoder device can be reduced. The input audio data is filtered into sub-bands. A masking threshold is generated for each sub-band. The bit allocation criteria is applied to each sub-band based on the signal to masking ratios (SMRs) of successive sub-bands. Thus, artifacts which may arise because of discontinuities between subsequent sub-bands may be prevented.

In the preferred embodiment of the present invention, the encoding device through which the audio signal passes includes a filter bank for filtering source audio data to produce frequency sub-bands, a psycho-acoustic modeler for calculating signal to masking ratios from the frequency sub-bands of the source audio data, and a bit allocator which uses the signal to masking ratios to assign a finite number of bits to represent the frequency sub-bands. In the absence of a significant event, the bit allocator performs a pre-bit allocation procedure to prevent artifacts or discontinuities in the encoded audio data.

In accordance with the present invention, an encoder filter bank initially divides frames of received source audio data into frequency sub-bands. In the preferred embodiment, the filter bank preferably generates thirty-two discrete sub-bands per frame, and then provides the sub-bands to a psycho-acoustic modeler and a bit allocator.

The psycho-acoustic modeler of the preferred embodiment receives the filtered audio data for the frequency sub-bands and uses it to generate signal to masking ratios, and then provides these signal to masking ratios to the bit allocator. Next, the bit allocator identifies the first sub-band of the first frame received from the filter bank, and allocates a finite number of bits to this sub-band using a bit allocation process. The bit allocator then advances to the next successive sub-band, which would be the first sub-band of the second frame of audio data.

The bit allocator then checks the new current sub-band for a significant event, In the preferred embodiment, the bit allocator detects a significant event whenever the difference in signal to masking ratios of successive sub-bands (the current sub-band and the immediately preceding sub-band) exceeds a selectable threshold value. Other criteria for determining a significant event are likewise contemplated for use with the present invention. The bit allocator may also compute a bit release time depending on the absolute value of the difference in Signal to masking ratios. To further detect signal perturbations, the difference in signal to mask ratios may be filtered with a low-pass filter.

If the bit allocator detects a significant event in the current sub-band, then the bit allocator performs the bit allocation procedure referred to above. However, if the bit allocator does not detect a significant event in the current sub-band, then the bit allocator performs a pre-bit allocation procedure. In the preferred embodiment, when no event is detected, the bit allocator assigns to the current sub-band the same bit which was assigned to the immediately preceding sub-band during the bit allocation procedure.

The process of either performing the bit allocation or pre-bit allocation procedures are continued until no more bits remained which can be assigned to the sub-bands of the audio data. The present invention thus efficiently and effectively refines the criteria by which bits are allocated to audio data and thus further refines a method for preventing artifacts in an audio data encoder device.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the description and drawings are for the purpose of illustration only and are not intended as a definition of the limits of the invention.

DESCRIPTION OF THE SPECIFIC EMBODIMENTS

Figure 1:
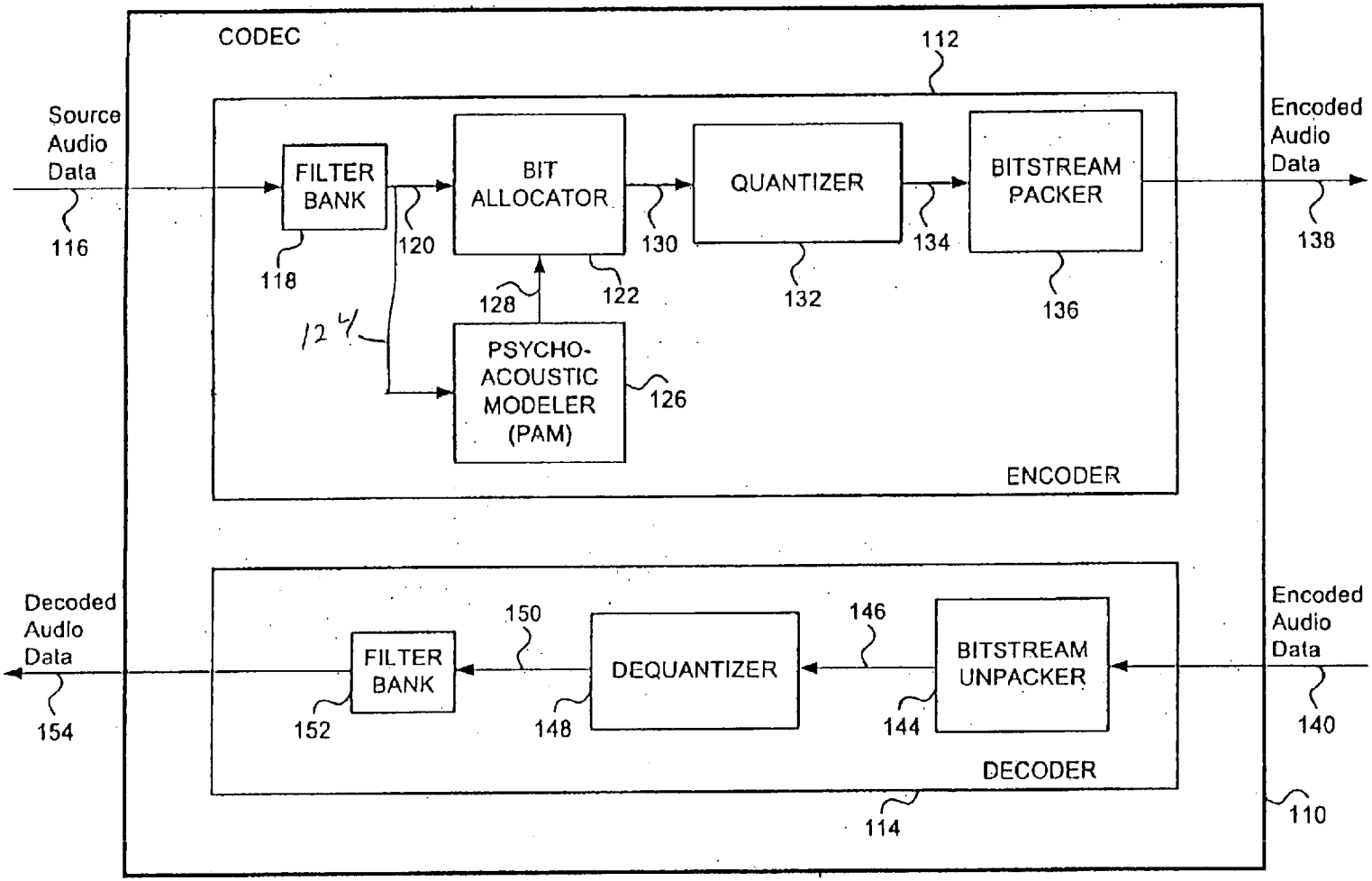
FIG. 1 is a partial block diagram for one embodiment of an encoder-decoder system in accordance with the present invention.

A block diagram for an encoder-decoder (codec) in accordance with the present invention is illustrated in FIG. 1. In the FIG. 1 embodiment, codec 110 comprises encoder 112 and decoder 114. Encoder 112 preferably includes a filter bank 118, a psycho-acoustic modeler (PAM) 126, a bit allocator 122, a quantizer 132, and a bit-stream packer 136. Decoder 114 preferably includes a bit-stream unpacker 144, a dequantizer 148, and a filter bank 152. The FIG. 1 embodiment specifically relates to encoding and decoding digital audio data; however, the present invention may advantageously be utilized to process and manipulate other types of electronic information.

During an encoding operation, encoder 112 receives source audio data from any compatible audio source via path 116. In the FIG. 1 embodiment, the source audio data on path 116 includes digital audio data that is preferably formatted in a linear pulse code modulation (LPCM) format. Encoder 112 preferably receives 16-bit digital samples of the source audio data in units called "frames." In the preferred embodiment, each frame contains 1152 samples.

In practice, filter bank 118 receives and separates the source audio data into a set of discrete frequency sub-bands to generate filtered audio data. In the FIG. 1 embodiment, the filtered audio data from filter bank 118 preferably includes thirty-two unique and separate frequency sub-bands. Filter bank 118 then provides the filtered audio data (sub-bands) to bit allocator 122 via path 120. The filtered audio data is also provided to psycho-acoustic modeler 126 via path 124.

Bit allocator 122 then accesses relevant information from PAM 126 via path 128 and responsively generates allocated audio data to quantizer 132 via path 130. Bit allocator 122 creates the allocated audio data by assigning binary digits (bits) to represent the signal contained in the sub-bands received from filter bank 118. The functionality of PAM 126 and bit allocator 122 are further discussed below in conjunction with FIGS. 2 and 3.

Figure 2:
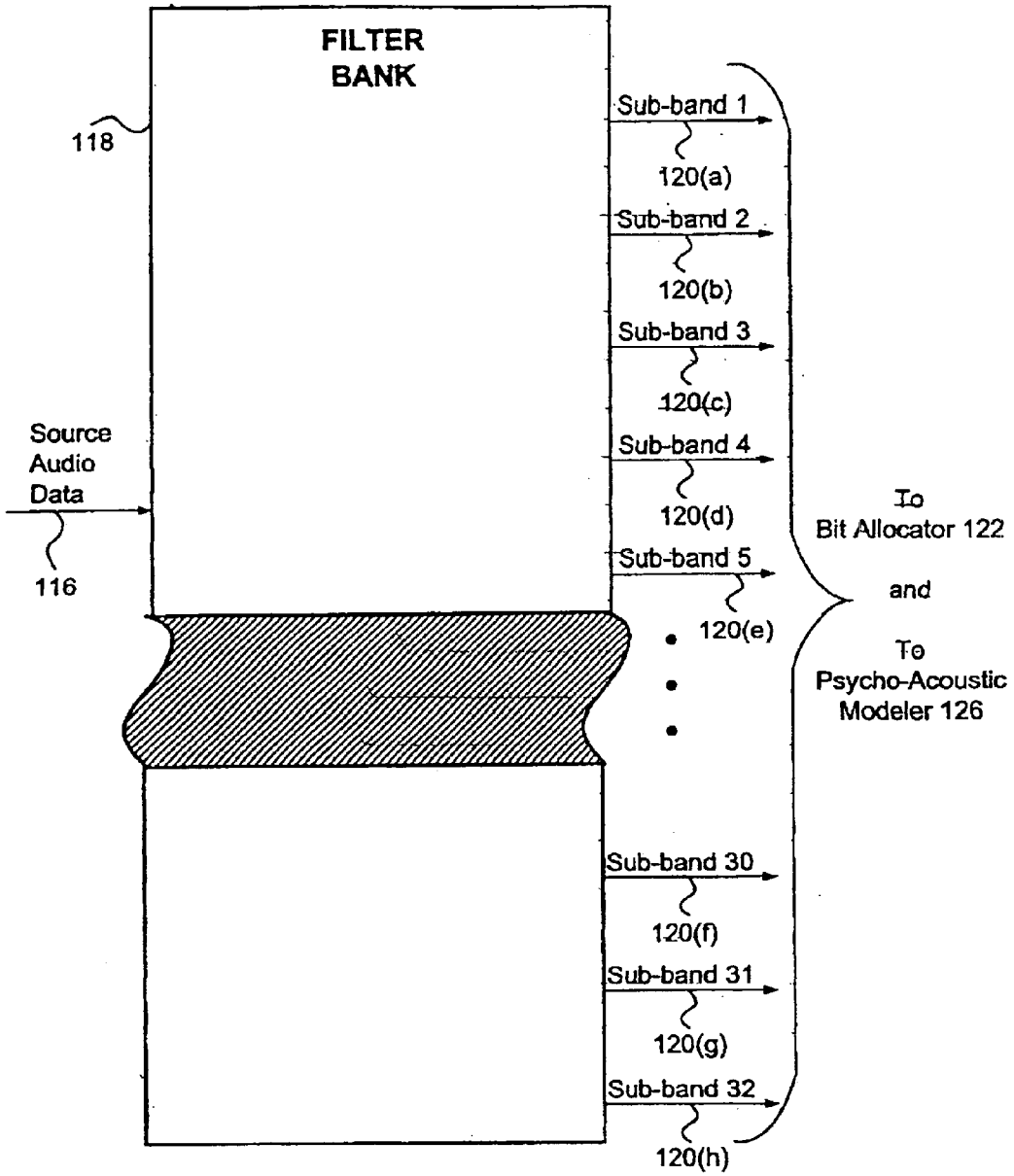
FIG. 2 is a block diagram for the embodiment of the encoder filter bank of FIG. 1, in accordance with the present invention.

Referring now to FIG. 2, a block diagram for one embodiment of the FIG. 1 encoder filter bank 118 is shown, in accordance with the present invention. In the FIG. 2 embodiment, filter bank 118 receives source audio data from a compatible audio source via path 116. Filter bank 118 then responsively divides the received source audio data into a series of frequency sub-bands which are each provided to bit allocator 122 and psycho-acoustic modeler 126. In the FIG. 2 embodiment, filter bank 118 preferably generates thirty-two sub-bands 120(*a*) through 120(*h*); however, in alternate embodiments, filter bank may readily output a greater or lesser number of sub-bands.

Figure 3:
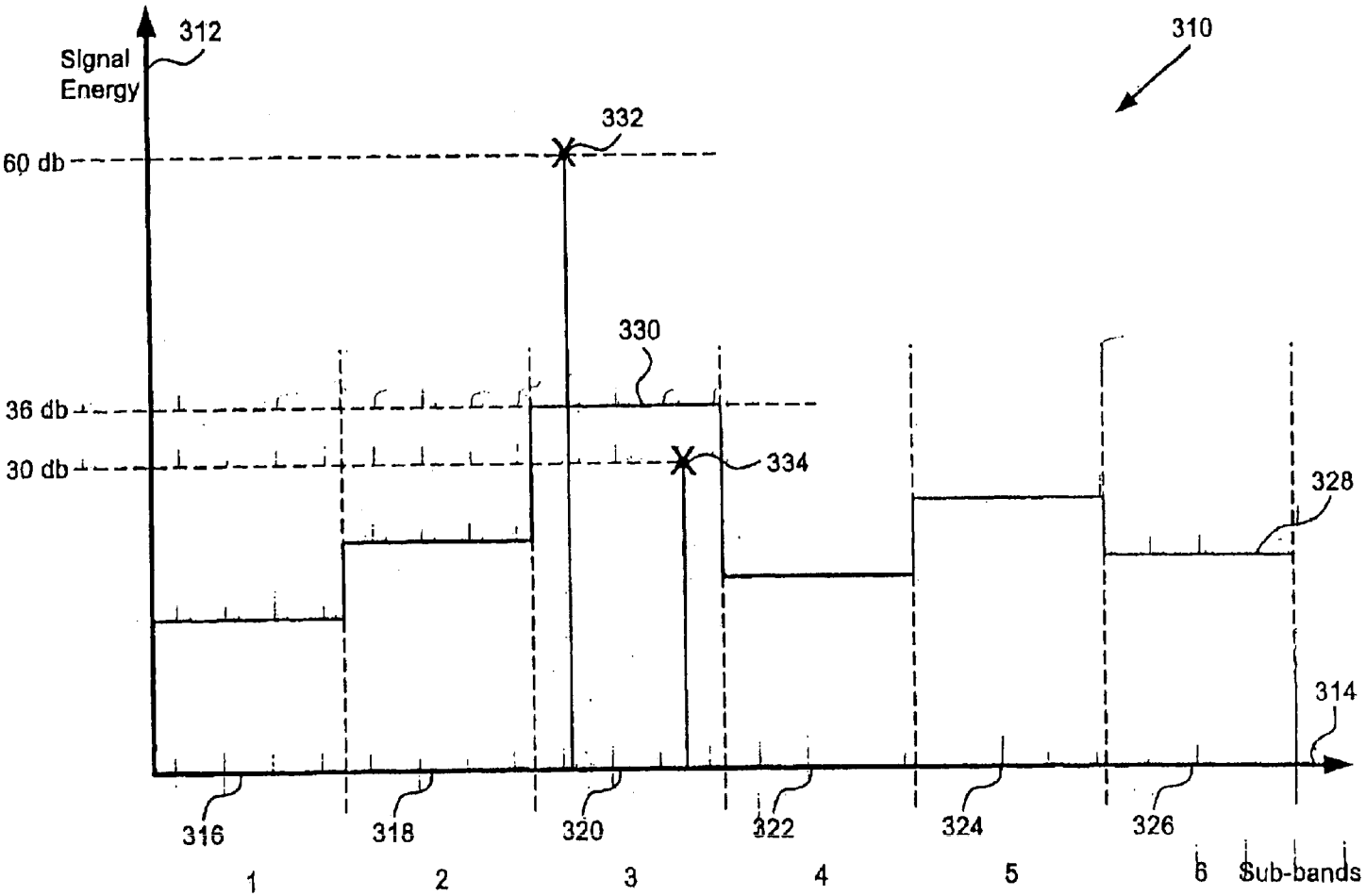
FIG. 3 is a graph for one embodiment of exemplary masking thresholds, in accordance with the present invention.

Referring now to FIG. 3, graph 310 for one embodiment of exemplary masking thresholds is shown, in accordance with the present invention. Graph 310 displays audio data signal energy on vertical axis 312, and also displays a series of frequency sub-bands on horizontal axis 314. Graph 310 is presented to illustrate principles of the present invention; therefore, the values shown in graph 310 are intended as examples only. The present invention may thus readily function with operational values other than those shown in graph 310 of FIG. 3.

In FIG. 3, graph 310 includes sub-band 1(316) through sub-band 6(326), and masking thresholds 328 that change for each FIG. 3 sub-band. Bit allocator 122 preferably receives sub-band 1 (316) through sub-band 6 (326) from filter bank 118, and also receives masking thresholds 328 from psycho-acoustic modeler 126. In operation, psycho-acoustic modeler (PAM) 126 receives the source audio data after it has passed through filter bank 118, sub-band by sub-band, and then utilizes characteristics of human hearing to generate the masking thresholds 328. Experiments have determined that human hearing cannot detect some sounds of lower energy when the lower energy sounds are close in frequency to a sounds of higher energy.

For example, sub-band 3 (320) includes a 60 db sound 332, a 30 db sound 334, and a masking threshold 330 of 36 db. The 30 db sound 334 falls below masking threshold 330, and is therefore not detectable by the human ear, due to the masking effect of the 60 db sound 332. In practice, encoder 112 may thus discard any sounds that fall below masking thresholds 328 to advantageously reduce the amount of audio data and expedite the encoding process.

Psycho-acoustic modeler (PAM) 126 uses the signal energy levels, in the frequency domain, from the frequency sub-bands of the source audio data to calculate masking thresholds 328. Calculating the masking thresholds is discussed in co-pending U.S. patent application Ser. No. 09/128,924, entitled "System and Method for Implementing a Refined Psycho-Acoustic Modeler," filed on Aug. 4, 1998, and in co-pending U.S. patent application Ser. No. 09/150,117, entitled "System and Method for Efficiently Implementing a Masking Function in a Psycho-Acoustic Modeler," filed on Sep. 9, 1998.

PAM 126 then calculates a series of signal to masking ratios for each sub-band by dividing the signal energies of the sub-bands by the corresponding masking thresholds 328. Finally, PAM 126 provides the calculated signal to masking ratios to bit allocator 122 via path 128 so that bit allocator 122 may perform an efficient bit allocation process to assign available allocation bits to the various sub-bands, in accordance with the present invention.

Bit allocator 122 must efficiently allocate a finite number of available bits to achieve optimal representation of the sub-bands received from filter bank 118 as filtered audio data. Bit allocator 122 may allocate bits to certain frequency sub-bands using various allocation techniques. In the preferred embodiment, bit allocator 122 allocates the available bits using a technique based on the sub-band signal to masking ratios received from psycho-acoustic modeler 126.

Figure 4:
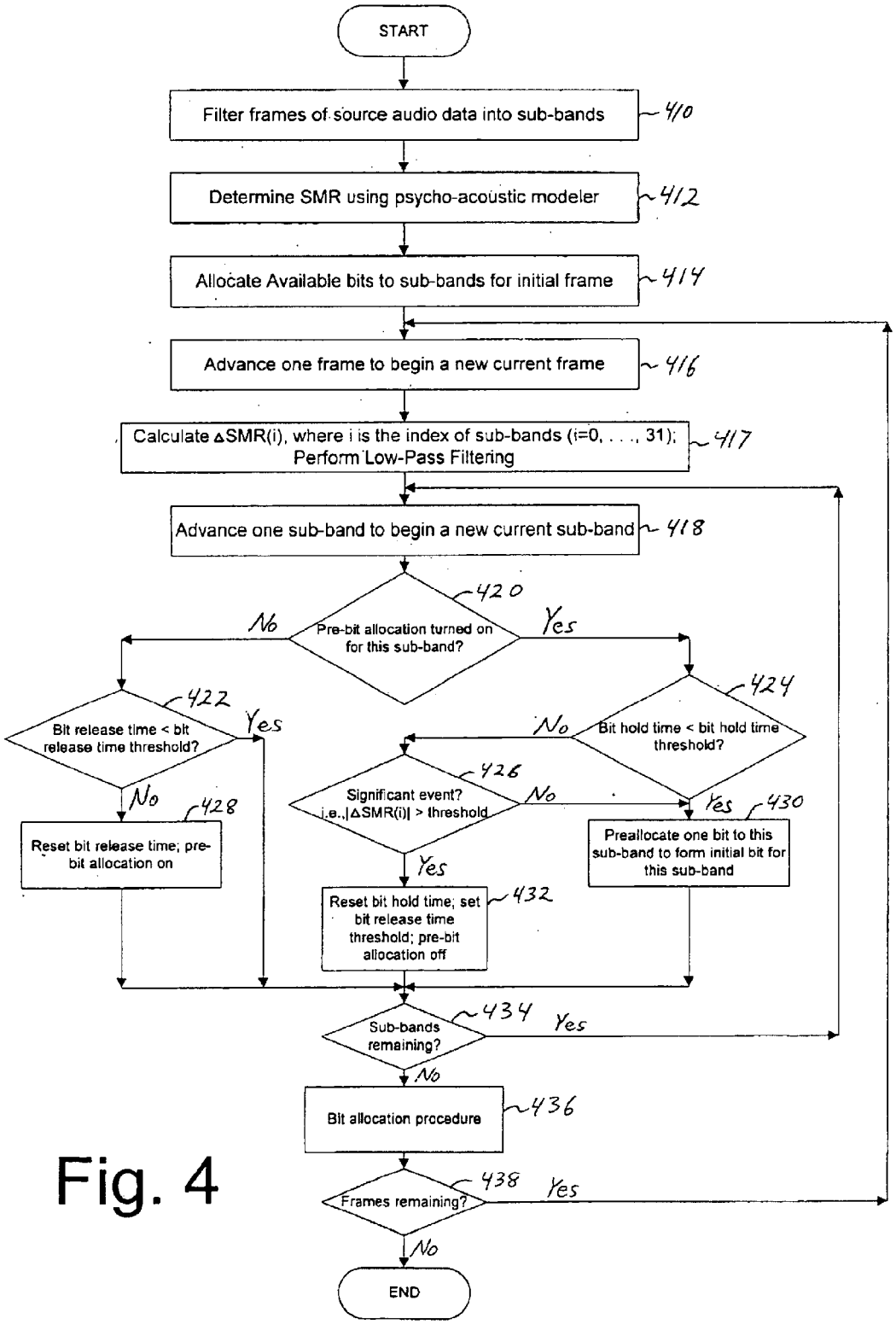
FIG. 4 is a flowchart of method steps for one embodiment of a method to refine the criteria used to prevent artifacts in an audio data encoder device, in accordance with the present invention.

Referring now to FIG. 4, a flowchart of method steps for the preferred embodiment of a method to prevent artifacts is shown, in accordance with the present invention. Initially, in step 410, encoder filter bank 118 filters frames of received source audio data into frequency sub-bands to produce filtered audio data. In the preferred embodiment, filter bank 118 preferably generates thirty-two discrete sub-bands, and then provides the sub-bands as filtered audio data to bit allocator 122 and psycho-acoustic modeler 126. In step 412, psycho-acoustic modeler 126 determines signal to masking ratios for the filtered source audio data, and then provides the signal to masking ratios to bit allocator 122. The signal to masking ratios generated by PAM 126 are discussed above in conjunction with FIG. 3.

In step 414, bit allocator 122 allocates bits for an initial frame for each sub-band received from filter bank 118. In the FIG. 4 embodiment, step 414 is preferably performed by executing a bit allocation process such as the bit allocation process discussed in co-pending U.S. patent application Ser. No. 09/220,320; entitled "System and Method for Preventing Artifacts in an Audio Data Encoder Device," filed on Dec. 24, 1998. Step 414 also sets or resets a pre-bit allocation flag to indicate whether pre-bit allocation is on or off.

In step 416, bit allocator 122 advances to a new current frame. At step 417 the ΔSMR is calculated for each sub-band. This value compares is the difference in SMR for a sub-band as compared to the SMR value for that sub-band in a prior iteration of the loop containing step 417. The sub-band index is advanced at step 418 so that processing of the next (or first) sub-band takes place. The sub-band indicated by the index becomes the "current" sub-band. Step 417 also performs low-pass filtering on the sub-bands.

At step 420 a check is made to determine whether pre-bit allocation is turned on for the current sub-band. If not, a check is made at step 422 to determine whether the bit release time is less than a predetermnined threshold. If so, execution proceeds to step 434 to advance to the next sub-band, if any. If the bit release time is not less than a predetermined threshold then execution first proceeds to step 428 where the bit release time is reset and the pre-bit allocation flag is set to indicate that pre-bit allocation is on before executing, step 434 to advance to the next sub-band, if any.

Bit release time at step 428 is determined by the size of the event in the current sub-band, and dictates to the bit allocator 122 for how many successive sub-bands, following the current sub-band, the pre-bit allocation procedure should be turned off. In the preferred embodiment of the present invention, the bit release time is computed to be proportional to the absolute value of the difference in signal to masking ratios in a sub-band for successive frames. A similar bit hold time 430 is applied to the sub-bands which pass through step 424 in which the pre-bit allocation procedure is turned on. The extent to which the current sub-band lacks an event dictates to the bit allocator 122 for how many sub-bands the pre-bit allocation procedure should be implemented.

Alternatively, at step 420, if pre-bit allocation is turned on for the current sub-band then execution proceeds to step 424. At step 424 a check is made as to whether the bit hold time is less than a predetermined threshold. If not, execution proceeds to step 426 where a check is made as to whether the absolute value of the ΔSMR for the current sub-band is greater than a threshold value. If so, step 432 is executed to reset the bit hold time, set the bit release time threshold, and to turn pre-bit allocation off. Execution then proceeds to step 434.

If, at step 424, it is determined that the bit hold time is less than the threshold value then execution proceeds to step 430. Execution also reaches step 430 if, at step 426, the absolute value of the ΔSMR is not greater than the threshold value (i.e., a significant event). In the preferred embodiment, bit allocator 122 detects a significant event whenever the difference in signal to masking ratios of successive sub-bands (i.e., the current sub-band and the same sub-band for the immediately preceding frame) exceeds a selectable threshold value. Bit allocator 122 computes the difference in signal to masking ratios for successive sub-bands. To further counterattack any perturbation in signal energy, the difference of the successive signal to masking ratios is filtered using a low-pass filter.

At step 430, a bit is pre-allocated to the current sub-band as the initial bit for the sub-band.

After either of steps 428, 432 or 430 are executed, a test is performed at step 434 to determine if there are other sub-bands (0–31) to process. If so, execution routes back to step 418. If not, step 436 is executed to allocate remaining available bits in a manner in accordance with the co-pending patent application Ser. No. 09/220,320; referenced above.

After bits are allocated by step 436, execution proceeds to step 438 where a test is made to determine if additional frames remain to be processed. If so, execution loops back to step 416. If not, execution terminates.

While a preferred embodiment of the present invention has been disclosed in detail, it is apparent that modifications and adaptations of that embodiment will occur to those skilled in the art. However, it is to be expressly understood that such modifications and adaptations are within the scope of the spirit and scope of the invention, as set forth in the following claims.

What is claimed is:

1. A method for allocating bits in an audio encoder system for encoding frames of input audio data, the method comprising:

filtering the input audio data into sub-bands in a first frame;

generating a masking threshold for each of the sub-bands in the first frame; and determining if a pre-bit allocation process will be implemented by cumulatively comparing corresponding sub-band signal to masking ratios in successive frames, wherein the determining comprises obtaining the difference of signal to masking ratios in corresponding sub-bands in a plurality of frames and determining whether the difference of signal to masking ratios exceeds a predetermined threshold.

2. The method of claim 1 wherein the method is implemented in the encoding section of a device designed to encode audio data.

3. The method of claim 1 wherein obtaining a difference of signal to masking ratios includes obtaining the absolute values of the difference of signal to masking ratios.

4. The method of claim 1 wherein said filtering includes filtering the input audio data into thirty-two frequency sub-bands.

5. The method of claim 1 further comprising passing the input audio data through a modeler, and generating a masking threshold for each sub-band as the filtered audio data is passed through the modeler.

6. The method of claim 5 wherein the modeler comprises a psycho-acoustic modeler.

7. The method of claim 5 wherein the passing includes comparing the input frequency sub-bands with properties of the human ear to determine the masking thresholds for each frequency sub-band.

8. The method of claim 1 further comprising calculating a signal to masking ratio using the masking threshold generated for each sub-band.

9. The method of claim 1 further comprising determining if a pre-bit allocation process will be implemented by comparing successive sub-band signal to masking ratios.

10. A method for allocating bits in an audio encoder system for encoding frames of input audio data, the method comprising:

filtering the input audio data into sub-bands in a first frame;

generating a masking threshold for each of the sub-bands in the first frame; and determining if a pre-bit allocation process will be implemented by cumulatively comparing corresponding sub-band signal to masking ratios in successive frames, wherein the determining includes computing the difference between successive sub-band signal to masking ratios, and filtering said difference using a low-pass filter.

11. The method of claim 10, additionally comprising computing a bit release time based on the difference between the signal to masking ratios of successive sub-bands.

12. The method of claim 11, wherein the computing includes computing a bit release time proportional to the absolute value of the difference between the signal to masking ratios of successive sub-bands.

13. A method allocating bits in an audio compression system, the method comprising:

filtering input audio data frames into sub-bands;

passing the input filtered audio data through a modeler;

generating a masking threshold for each sub-band as the filtered audio data is passed through the modeler;

calculating the signal to masking ratios of successive sub-bands; and determining if a pre-bit allocation process will be implemented by cumulatively comparing corresponding sub-band signal to masking ratios in successive frames, wherein the determining includes computing the difference between successive sub-band signal to masking ratios, and filtering said difference using a low-pass filter.

14. The method of claim 13 wherein the method is implemented in the encoding section of a device designed to encode and decode audio data.

15. The method of claim 13, wherein said filtering includes filtering the input audio data into thirty-two frequency sub-bands.

16. The method of claim 13 wherein the modeler comprises a psycho-acoustic modeler.

17. The method of claim 13 wherein the passing further includes comparing the input frequency sub-bands with properties of the human ear to determine the masking thresholds for each frequency sub-band.

18. The method of claim 13, additionally comprising computing a bit release time based on the difference between the signal to masking ratios of successive sub-bands.

19. The method of claim 18, wherein the computing includes computing a bit release time proportional to the absolute value of the difference between the signal to masking ratios of successive sub-bands.

20. A method for allocating bits in an audio encoder system for encoding frames of input audio data, the method comprising:

filtering the input audio data into sub-bands;

generating a masking threshold for each of the sub-bands;

calculating a signal to masking ratio using the masking threshold generated for each sub-band;

computing a difference between successive sub-band signal to masking ratios;

determining if a pre-bit allocation process will be implemented by cumulatively comparing corresponding sub-band signal to masking ratios in successive frames;

computing a bit release time based on the difference between the signal to masking ratios of successive sub-bands, wherein the bit release time computing includes computing a bit release time proportional to the absolute value of the difference between the signal to masking ratios of successive sub-bands.

21. The method of claim 20, additionally comprising filtering said difference using a low-pass filter.

22. An audio encoder system for input audio data frames comprising:

a filter which filters the input audio data frames into sub-bands;

a psycho-acoustic modeler which generates a masking threshold for each sub-band and calculates the signal to masking ratio for the sub-bands;

a comparator for determining if a pre-bit allocation process will be implemented by cumulatively comparing corresponding sub-band signal to masking ratios in successive frames; and a bit allocator which assigns or not assigns pre-bit allocation to each sub-band based on a comparison of signal to masking ratios of successive sub-bands, wherein the bit allocator calculates the difference between the signal to masking ratios of successive sub-bands, and includes a low-pass filter for filtering said difference.

23. An audio encoder system for input audio data frames comprising:

a filter which filters the input audio data frames into sub-bands;

a psycho-acoustic modeler which generates a masking threshold for each sub-band and calculates the signal to masking ratio for the sub-bands;

a comparator for determining if a pre-bit allocation process will be implemented by cumulatively comparing corresponding sub-band signal to masking ratios in successive frames; and a bit allocator which assigns or not assigns pre-bit allocation to each sub-band based on a comparison of signal to masking ratios of successive sub-bands, wherein the bit allocator computes a bit release time based on the difference between the signal to masking ratios of successive sub-bands.

* * * * *